United States Patent [19]

Lequesne

[11] Patent Number: 4,779,582

[45] Date of Patent: Oct. 25, 1988

[54] BISTABLE ELECTROMECHANICAL VALVE ACTUATOR

[75] Inventor: Bruno P. B. Lequesne, Royal Oak, Mich.

[73] Assignee: General Motors Corporation, Detroit, Mich.

[21] Appl. No.: 84,400

[22] Filed: Aug. 12, 1987

[51] Int. Cl.[4] ..... F01L 9/04

[52] U.S. Cl. ..... 123/90.11; 251/129.10; 335/234

[58] Field of Search ..... 123/90.11; 251/129.10, 251/129.16, 129.07; 335/234

[56] References Cited

U.S. PATENT DOCUMENTS

| | | | |
|---|---|---|---|
| 1,471,861 | 10/1923 | Perrault | 123/90.11 |
| 3,202,886 | 8/1965 | Kramer | 335/234 |
| 3,504,315 | 8/1970 | Stanwell | 335/234 |
| 3,853,102 | 12/1974 | Myers et al. | 123/90.11 |
| 3,882,833 | 5/1975 | Longstaff et al. | 123/90.11 |
| 4,383,234 | 5/1983 | Yatsushiro et al. | 335/253 |
| 4,455,543 | 6/1984 | Pischinger et al. | 335/266 |
| 4,533,890 | 8/1985 | Patel | 335/234 |
| 4,614,170 | 9/1986 | Pischinger et al. | 123/90.11 |

OTHER PUBLICATIONS

SAE Paper No. 790119 Entitled "Helenoid Actuators—A New Concept in Extremely Fast Acting Solenoids", pp. 1-3. (2/26-3/2 '79).

*Primary Examiner*—E. Rollins Cross

*Attorney, Agent, or Firm*—Robert M. Sigler

[57] ABSTRACT

A valve member is latched into open or closed positions by permanent magnetic poles against the force of compressed springs. A coil associated with each position, when activated with a current, cancels the magnetic field of the permanent magnetic pole holding the valve member and allows the compressed spring to move the member quickly through a central neutral position toward the other position, whereupon it is attracted by the other magnetic pole to compress the other spring and latch into the other position. Variations on the basic invention include different structures for single valves, the inclusion of two valves within a single pair of coils with different opening current levels, and the use of the coil opposite the activating coil as a valve member movement sensing device.

4 Claims, 3 Drawing Sheets

BISTABLE ELECTROMECHANICAL VALVE ACTUATOR

BACKGROUND OF THE INVENTION

This invention relates to bistable electromechanical actuators such as those which may be used with intake and exhaust valves for the combustion chambers of an internal combustion engine. Such valves are customarily mechanically activated by a camshaft; but several actuators using electromagnetic forces have been suggested in the prior art. The latter actuators, if practical, have potential for improving engine performance by providing control of intake and/or exhaust valve operation and thus making valve timing variable in engine operation; however, none suggested so far has been sufficiently practical to supplant the ordinary mechanical actuating schemes.

One type of electromagnetic valve actuating device which has been suggested is the solenoid. Conventional solenoids operate by electromagnetically generated attractive forces built by inducing a flux in a moving armature. The magnitude of these forces, however, decreases rapidly over the distance which the armature travels. In typical engine valve applications, this is equal to the valve lift of typically 10 mm, a comparatively large distance. One proposed solution is the helenoid actuator suggested by A. H. Seilly in the SAE Paper No. 790119 entitled "Helenoid Actuators—A New Concept in Extremely Fast Acting Solenoids", published in 1979. In a helenoid actuator, a plunger is moved over a smaller gap with the displacement being amplified by a lever. The lever, however, adds mass to the system; and a large amount of energy is required to move the valve.

A magnet in the armature can help generate strong repulsion forces at the beginning of the armature motion, as shown in the U.S. Pat. Nos. to Kramer 3,202,886, issued Aug. 24, 1965, Stanwell 3,504,315, issued Mar. 31, 1970 and Patel 4,533,890, issued Aug. 6, 1985. However, the solenoid current level of these schemes is high, since it must generate sufficient force to overcome the magnetic attraction as well as to provide the kinetic energy of valve motion. In addition, due to the high seating velocity, braking means may be required for the valve.

Oscillating systems of the spring-mass type, for example, can store amounts of energy significantly larger than the small amount of energy required to overcome friction and spring losses. Solenoids can be used to latch such a system at either end of its stroke. In addition, magnetic forces from the solenoid can compensate for the losses of the system. Such a system is shown in the U.S. Pat. No. 4,455,543 to Pischinger et al, issued June 19, 1984. However, in the system of that patent, electrical energy is continuously consumed while the valve is latched in either of the open and closed positions. In addition, upon system initiation, provision must be made to preload the system by moving the valve against the springs to the open or closed position from a middle position to which it returns when neither solenoid is actuated. A third coil is proposed; and this adds to the complexity of the device. An alternative initialization method not requiring the third coil is proposed in the U.S. Pat. No. 4,614,170 to Pischinger et al. However, this method requires complex control routines and delays start up. In addition, since the valves are open in an intermediate position when the engine is off, Pishinger et al add an auxiliary valve (30 in FIG. 5), which further increases cost and complexity.

SUMMARY OF THE INVENTION

The apparatus of this invention retains the advantageous features of a solenoid latched spring-mass oscillating system but with reduced energy consumption and no need for preloading upon startup.

The appartus of the invention uses permanent magnets to latch the valve closing member into at least the closed position and, in some embodiments, the open position, against the force of compressed springs. Recently developed powerful permanent magnetic materials enable such magnets to be small and light. A coil associated with each position, when activated with a current, cancels the magnetic field of the permanent magnet pole holding the valve closing member and allows the compressed spring to move the member quickly through a central neutral position toward the other position, whereupon it is attracted by the other magnetic pole to compress the other spring and latch into the other position.

Variations on the basic invention include different structures for single valves, the inclusion of two valves within a single pair of coils with different opening current levels so that a first current level within the appropriate coil releases the first valve with a higher current required to release the second valve. In addition, since there is a coil for each of the closed and open positions, one coil may be used as a valve movement sensing element while the other is being activated so as to provide valve movement confirming feedback to a control system utilizing the apparatus. Further details and advantages of the invention will be apparent from the accompanying drawings and following description of a preferred embodiment.

DESCRIPTION OF THE PREFERRED EMBODIMENT

Figure 1:
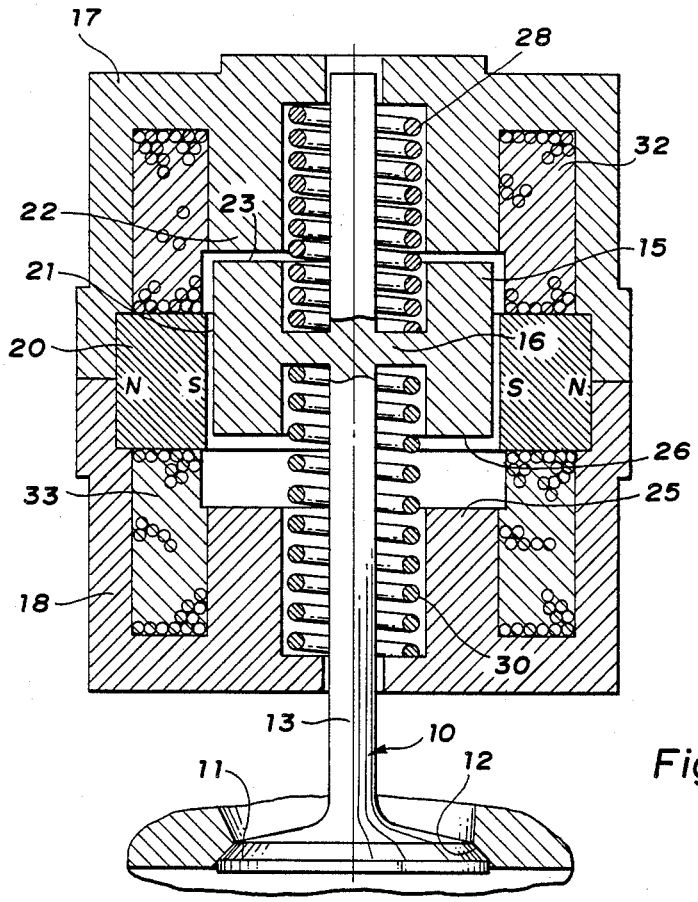
FIGS. 1, 2 and 3 show alternative single valve embodiments of the apparatus of this invention.
Figure 4:
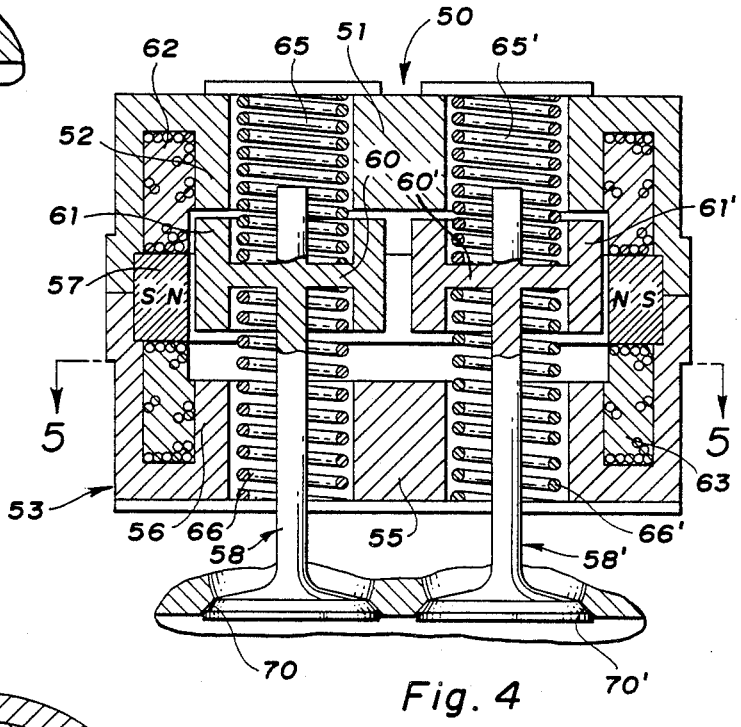
FIG. 4 shows a dual valve variation of the apparatus of this invention in which a single coil can actuate both valves at different current levels.
Figure 5:
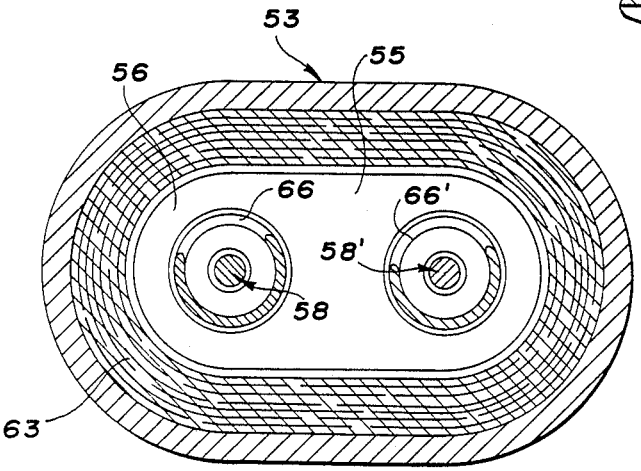
FIG. 5 is a section view along lines 5—5 in FIG. 4.

Referring to FIG. 1, a valve closing member 10 has a valve head 11 which, in a closed position, seats against and thereby closes an engine intake or exhaust port with a valve seat 12. Valve member 10 has a stem 13 including, at a point spaced from head 11, an annular plunger 15 made of magnetic material and attached to stem 13 by a circular plate 16. Upper and lower magnetic frame members 17 and 18, made of magnetic material, together comprise a magnetic frame and hold an annular permanent magnet 20 having radially inner and outer poles. The word "annular", as used in this specification and the following claims, is not to be restricted to a circular shape. Rectangular and other shapes may be used. Another non-circular example is shown in the embodiment of FIGS. 4, 5, to be described at a later point in this specification. Plunger 15, magnetic frame members 17, 18 and permanent magnet 20 together comprise a magnetic circuit having an annular radial air gap between the radially inner pole S of permanent magnet 20 and the radially outer surface 21 of plunger 15 which does not vary significantly with axial plunger movement. A variation of this structure not shown in the Figures but within the scope of the claims would include a thin annular sleeve of a magnetic material such as soft steel on the inner annular surface of magnet 20 adjacent plunger 15. The purpose of the sleeve would be to better distribute the flux of magnet 20, prevent local demagnetization of the magnet, protect the magnet from chipping or other physical damage and generally facilitate assembly of the unit.

Although it does not show in FIG. 1, plunger 15 is preferably made with a plurality of axial slots extending radially inward from the outer circumference through a substantial portion of the annular thickness thereof to reduce eddy current losses. For example, the use of twenty four evenly spaced slots has produced energy savings of as much as 39 percent. The slots should be made as thin as possible to be practical. The use of an Electric Discharge Machining (EDM) technique has produced slots as narrow as 0.004 inches, which removes a negligible amount of material from plunger 15.

Figure 7:
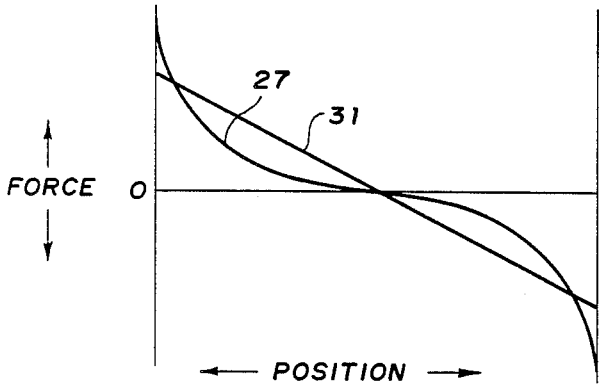
FIG. 7 is a diagram of force vs. position for the springs and magnetic circuits of the embodiments of FIGS. 1–5 showing the bistable nature of the apparatus.

The magnetic circuit further has an axial air gap between a first pole 22 formed by upper magnetic frame member 17 and the upper axial surface 23 and between a second pole 25 formed by lower magnetic frame member 18 and the lower axial surface 26. This compound magnetic circuit varies with plunger 15, and therefore valve member 10, position to produce the magnetic force curve 27 of FIG. 7.

An upper spring 28 is compressed between upper magnetic frame member 17 and plate 16 of valve member 10. A lower spring 30 is compressed between lower magnetic frame member 18 and plate 16. Springs 28 and 30 are preferably coil springs; although other types may be used. They combine to produce a spring force on valve member 10 as shown by curve 31 of FIG. 7, a force always tending to return valve member 10 toward a neutral position between the open and closed positions thereof. The combined forces oppose each other and cancel to form two stable positions for valve member 10: one in the closed position shown in FIG. 1, with plunger 15 adjacent pole 22 of magnetic frame member 17; the other in the open position, with plunger 15 adjacent pole 25 of lower magnetic frame member 18. There is a potential third stable position in the neutral position midway between the others. However, in normal operation, as will be seen, this position is never a final resting place for the apparatus, which may be considered a bistable device.

An upper coil 32 is wound around pole 22 of upper magnetic frame member 17; and a lower coil 33 is wound around pole 25 of lower magnetic frame member 18. Each of coils 32 and 33 is effective, when provided with a predetermined current pulse, to cancel the magnetic force of the adjacent pole, whereby the associated spring 28 or 30 imparts a rapid acceleration of valve member 10 out of its position adjacent the pole. The inertia of valve member 10 carries it well past the neutral position midway between the poles, a position it passes with maximum velocity. Although, on the other side of the neutral position, valve member 10 loses kinetic energy as it compresses the other of springs 28 and 30, it coasts sufficiently close to the opposite pole to be attracted thereto. It thus becomes latched in the opposite position until the opposite coil is activated to return valve member 10 in like manner to its original position.

Several advantages of the operation of this apparatus should be noted. First, although the spring delivers high initial acceleration to produce high kinetic energy in valve member 10 and thus quick movement thereof, the kinetic energy is converted back to potential energy by the other spring, which tends to brake valve member 10 before it seats in the opposite position. Secondly, no current is required to maintain valve member 10 in either latched position, so that overall energy consumption of the apparatus is low. Thirdly, the initial spring loading of the apparatus can be set in manufacturing with valve member 10 in one of the latched positions with no additional provision to periodically re-load the apparatus.

Figure 2:
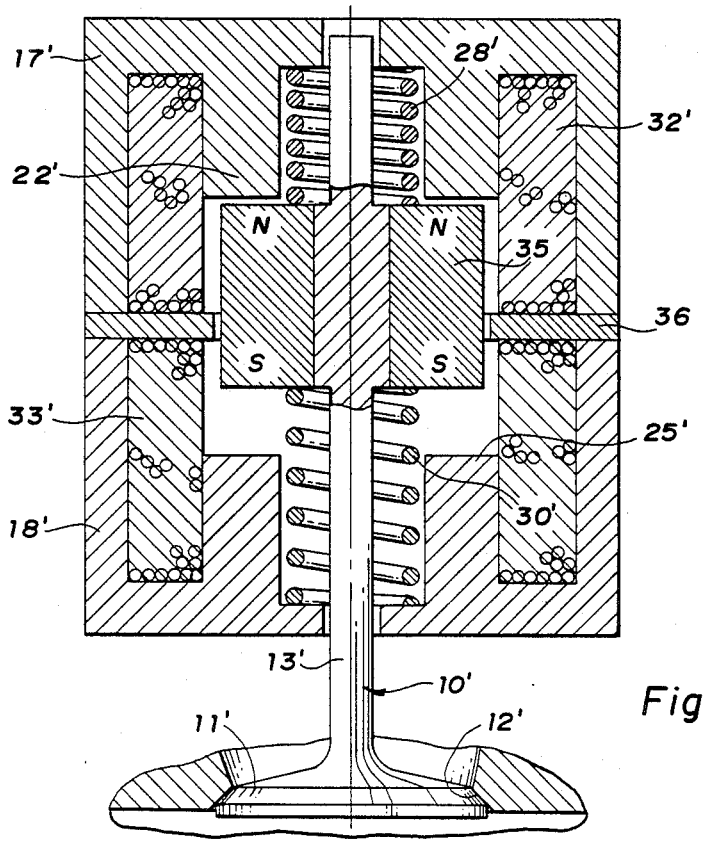

A variation of the apparatus of FIG. 1 is shown in FIG. 2. Members which are essentially unchanged are given similar primed reference numerals. In this embodiment, the permanent magnet 35 is an annular magnet mounted on valve stem 13', which takes the place of both plunger 15 and plate 16 of FIG. 1. An annular magnetic flux member 36 is placed between magnetic frame members 17 and 18 in place of permanent magnet 20 of FIG. 1 to complete the magnetic flux circuit. The operation of the apparatus of FIG. 2 is identical with that of FIG. 1, already described.

Figure 3:
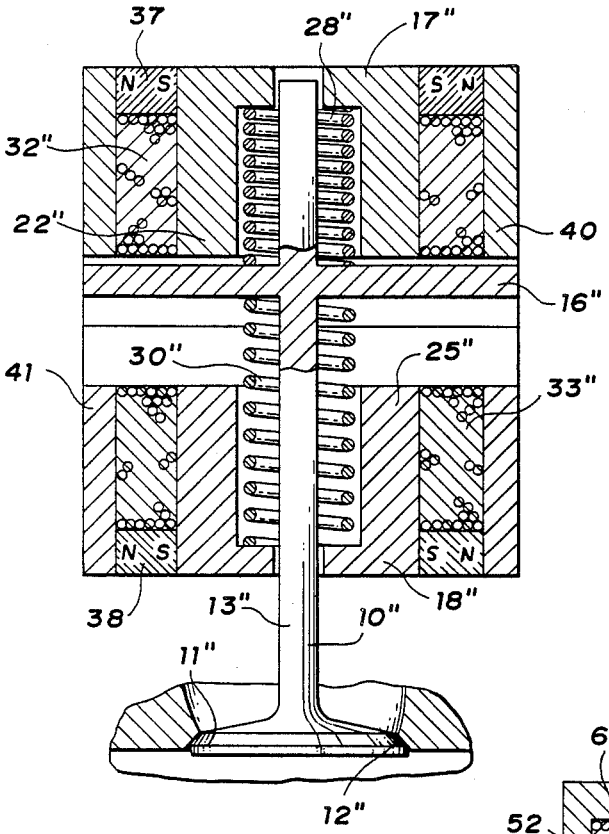

Another variation of the apparatus of FIG. 1 is shown in FIG. 3. In this embodiment, essentially similar elements are shown with double primed reference numerals. A pair of annular permanent magnets 37, 38 is provided, one magnet for each of magnetic frame members 17" and 18", which members are axially separated from each other. Plate 16" is provided on valve stem 13" as in the embodiment of FIG. 1; but it extends radially across the full radial extent of members 17 and 18 with no annular plunger attached. The operation of the apparatus of FIG. 3 is similar to that of FIGS. 1 and 2, with plate 16" completing the magnetic circuit between inner annular pole 22" and an outer annular pole 40 of magnetic frame member 17 at the upper limit of its travel and a magnetic circuit between inner annular pole 25" and an outer annular pole 41 of magnetic frame member 18 at the lower limit of its travel, which limits correspond to the closed and open positions, respectively.

A variation of the embodiment of FIG. 3 is not separately shown, since it differs only in the replacement of permanent magnet 38 with a member of soft magnetic but not permanently magnetized material. Magnet 37 would still accomplish latching in the valve closed position and retain the valve closed after elctric power is shut off. Since the type of valves involved are closed most of the time, most of the valves in an engine would be in the permanent magnet latched closed state at any given time. There would be an increased energy requirement for retention of the valves in the open position; but the overall solenoid cost would be lower.

The apparatus of FIGS. 4 and 5 is a dual valve embodiment of the invention, where the dual valves are both of the same type (i.e., intake or exhaust) but one is designed to open before the other. An upper magnetic frame member 50 defines a central pole 51 and outer annular pole 52. Similarly a lower magnetic frame member 53 defines a central pole 55 and an outer annular pole 56. Members 50 and 53 are joined together at their periphery and enclose an annular permanent magnet 57 positioned similarly to magnet 20 of FIG. 1. A pair of valves 58 and 58', which close against valve seats 70 and 70', respectively, have mounted thereon plates 60 and 60' and annular plungers 61 and 61', similarly to the arrangement of FIG. 1. A single upper coil 62 surrounds poles 51 and 52 of upper magnetic frame member 50; a single lower coil 63 surrounds poles 55 and 56 of magnetic frame member 53. Springs 65 and 66 urge valve 58 to a neutral position; while springs 65' and 66' urge valve 58' to a neutral position. However, each of valves 58 and 58' are bistable with a force characteristic as shown in curves 27 and 31 of FIG. 7; and the apparatus operates generally as does that of FIG. 1.

Figure 6:
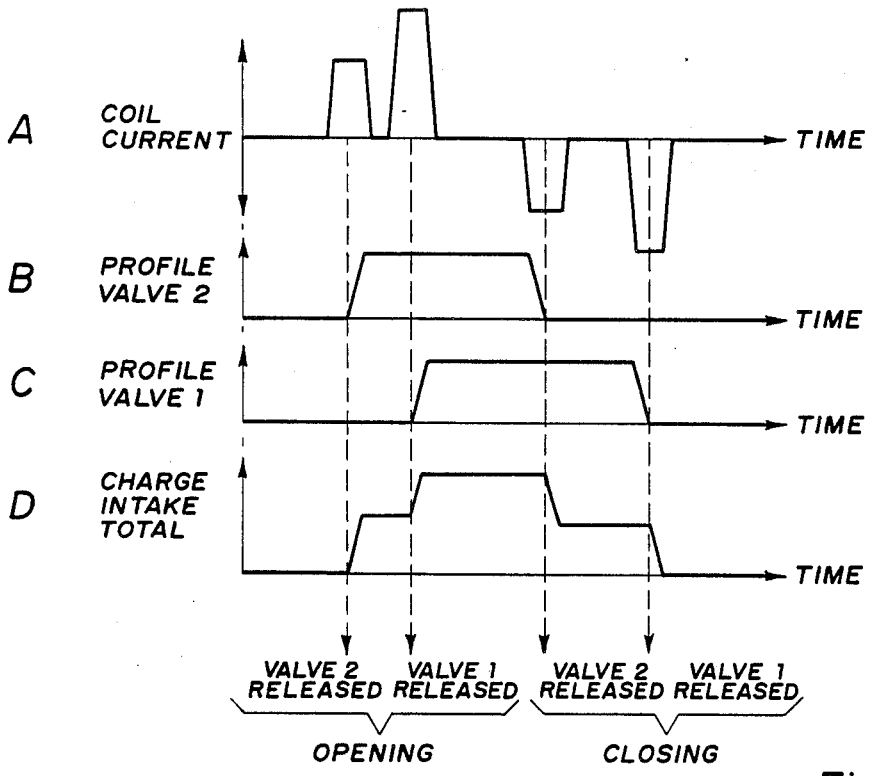
FIGS. 6A–6D show timing diagrams of various parameters illustrating the operation of the apparatus of FIGS. 4–5.

However, not easily shown in FIGS. 4 and 5 is the fact that the springs, magnetic circuits and coils of the apparatus are designed to cause one of valves 58 and 58' to be released from one of its latched positions at a lower current level than the other is released from its similar latched position. To this end, the spring constants of springs 65 and 66, on one hand, and springs 65' and 66', on the other hand, may be different or the magnetic circuits for the two valves 58 and 58' may be different. Thus, a current through coil 62, for example, equal to the lower current should be sufficient to open valve 58, with a greater current through the same coil at a later time being effective to additionally open valve 58'. The operation is shown in the curves of FIGS. 6A–6D for opening and closing of the valves. FIG. 6A shows the coil current pulsed to a first maximum value to cause one of the valves to open, as shown in FIG. 6B. This is followed by a pulse to a larger maximum value which is sufficient to open the other valve as shown in FIG. 6C. The closing pulses and their results are shown in the same Figures. The overall charge intake total, assuming the valves are combustion chamber intake valves, is shown in FIG. 6D. Thus, a more complex valve opening profile is possible with control of valve and profile timing in a dual valve apparatus which is significantly more compact than dual solenoids.

It may be desirable, as part of the valve control for the apparatus of this invention, to provide a feedback signal indicating valve response to the activating currents of the coils. Since the apparatus has two coils—one to initiate valve opening and one to initiate valve closing—and only one is used at a time, the other coil is free to be used as a sensing coil. It is located in a position where it will change its inductance with motion of the valve apparatus and therefore will be effective to provide such feedback.

Figure 8:
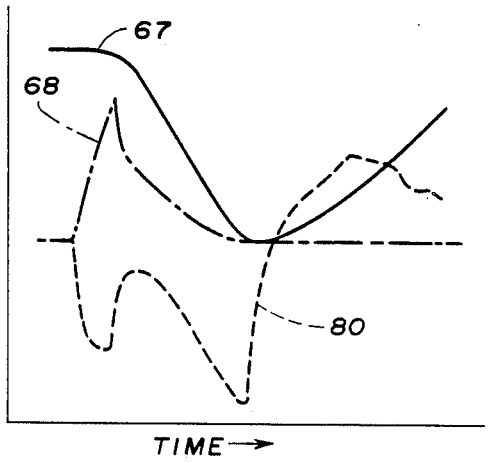
FIG. 8 is a timing diagram of various electrical parameters illustrating the use, in one of the embodiments of FIGS. 1–5, of the non-activated coil as a valve motion sensing feedback signal generating element.

FIG. 8 shows valve motion in curve 67, activating current in the activating coil in curve 68 and generated EMF in the sensing coil in curve 80 for a case in which the valve rebounds from the desired position back toward the original position instead of latching in the desired position. The zero levels of curves 68 and 80 are seen in the extreme left and right of curve 68. It should be noted that the sign of the EMF changes on the rebound and thus is an indication thereof. It should also be noted that the EMF just prior to rebound was quite high (in the negative direction), which would provide an indication that rebound was about to occur. The control could be designed to respond to such a signal by applying a braking force by temporarily and partially cancelling the attractive magnetic force of the destination pole or by some other means, in order that rebound is prevented.

The embodiments of the invention in which an exclusive property or privilege is claimed are defined as follows:

1. An electromechanical valve actuating device for an internal combustion engine, the valve comprising a valve closing member movable between a closed position against a valve seat and an open position away from the valve seat, the valve actuating device comprising, in combination:

spring means effective to bias the valve toward a neutral position between the closed and open positions;

permanent magnet means;

magnetic means including the permanent magnet means establishing a pair of magnetic flux circuits with magnetic pole pieces, at least a portion of the magnetic means being fixed to the valve for movement therewith so as to approach one of the pole pieces in the closed position of the valve and the other of the pole pieces in the open position of the valve, each of the magnetic flux circuit including an air gap between the portion of the magnetic means and the respective pole piece which decreases as the portion of the magnetic means approaches the respective pole piece and is significantly greater in the neutral position so as to create a magnetic attraction between the portion of the magnetic means and the respective pole piece which increases as the former approaches the latter and is sufficient, with the valve closing member in either of its closed or open positions to retain the valve in that position against the force of the spring; and a pair of coils associated with the magnetic means, one for each of the closed and open positions of the valve, each of the coils positioned and wound so as to be effective when activated with an electric current therethrough to cancel the flux from the associated permanent magnet and thus the magnetic attraction between the corresponding pole piece and the portion of the magnetic means fixed to the valve, whereby the spring means is effective to move the valve closing member away from the corresponding pole piece and through the neutral position toward the other pole piece, whereby the valve closing member is attracted and retained in the other of the closed and open positions.

2. The electromechanical valve actuating device of claim 1 which includes first and second valve closing members independently movable between closed positions against first and second valve seats, respectively and open positions away from the first and second valve seats, the magnetic means being effective to establish a magnetic flux circuit with opposed magnetic pole pieces for each valve closing member, the spring means being effective to bias each valve closing member toward a neutral position between the closed and open positions, each of the pair of coils being associated with both the first and second magnetic means, and the magnetic means, spring means and coils together establishing a difference between the first and second valve closing members in the current level in the coils required to release the valve closing member from one of the open and closed positions, whereby a first current level in one of the coils is sufficient to release one of the first and second valve closing members from one of the open and closed positions and a second, higher current level is required to release the other of the first and second valve closing member from the same position.

3. The electromechanical valve actuating device of claim 1 further comprising means associated with one of the coils to detect, by means of fluctuations in an electrical parameter of the one of the coils, movement of the valve closing member due to activation of the other of the coils.

4. An electromechanical valve actuating device for an internal combustion engine, the valve comprising a valve closing member movable between a closed position against a valve seat and an open position away from the valve seat, the valve actuating device comprising, in combination:

spring means effective to bias the valve toward a neutral position between the closed and open positions;

a permanent magnet;

magnetic means including at least a portion of the valve closing member projecting between the first and second coils, the magnetic means being effective to establish a magnetic flux circuit including the portion of the valve closing member, a pole piece, the permanent magnet and a first air gap between the pole piece and the portion of the valve closing member which decreases as the valve closing member approaches the closed position from the neutral position;

a coil adjacent the permanent magnet, the coil being positioned and wound so as to be effective when activated with an electric current therethrough to cancel the magnetic attraction between the first pole piece and the portion of the valve closing member, whereby the spring means is effective to move the valve closing member away from the closed position and through the neutral position toward the open position;

means for selectively retaining the valve closing member in the open position.

* * * * *